US005771991A

United States Patent [19]

Fresco

[11] Patent Number: 5,771,991

[45] Date of Patent: Jun. 30, 1998

[54] SUPPORT DEVICE ATTACHABLE TO A BUILDING SUPPORT MEMBER

[76] Inventor: Johnny Fresco, 120 Green St., Doylestown, Pa. 18901

[21] Appl. No.: 502,350

[22] Filed: Jul. 14, 1995

[51] Int. Cl.[6] ..... E04G 3/00

[52] U.S. Cl. ..... 182/82; 248/235

[58] Field of Search ..... 182/82, 87, 45; 248/235, 240, 228.1, 228.4

[56] References Cited

U.S. PATENT DOCUMENTS

| | | | |
|---|---|---|---|
| 1,456,940 | 5/1923 | Showalter | 182/45 |
| 2,605,074 | 7/1952 | Bucsko et al. | 248/235 |
| 2,854,293 | 9/1958 | Riblet . | |
| 3,044,573 | 7/1962 | Jackson | 182/87 |
| 3,322,387 | 5/1967 | Fortin, Sr. | 248/235 |
| 3,776,498 | 12/1973 | Peters et al. | 182/82 |
| 4,452,336 | 6/1984 | Sickler | 182/82 |
| 5,156,235 | 10/1992 | Preston | 182/178 |

*Primary Examiner*—Ramon O. Ramirez
*Assistant Examiner*—Anita M. King
*Attorney, Agent, or Firm*—Joseph W. Molasky & Associates

[57] ABSTRACT

A support device for holding building materials and the like which includes: a body; clamping means having a lever mechanism and skid-resistant means attached to one end of the body; a brace having slip resistance means and extending diagonally from an end of the body opposite that to which the clamping means are attached; the clamping means being arranged to be secured onto a building support member and the brace arranged to be secured to the support member at a position spaced apart from where the clamping means are secured, thereby, forming a triangular support device with the body, brace, and building support member. A lever mechanism is arranged to both open a movable part of the clamping means and close such movable part causing the clamping means to securely grip the building support member. The movable part of the clamping means is arced to securely fit building support members of varying thicknesses. The lever mechanism includes an adjustable pivot bar arranged to open and close the clamping means to securely grip the building support member such as a stud or a rafter.

8 Claims, 4 Drawing Sheets

SUPPORT DEVICE ATTACHABLE TO A BUILDING SUPPORT MEMBER

BACKGROUND OF THE INVENTION

This invention relates to building support apparatuses and devices for supporting and holding building materials such as scaffolding, roof sheeting, and such other materials as may be needed in building homes and the like.

Typical of existing known supporting devices is the scaffolding support described in Preston, U.S. Pat. No. 5,156,235. This scaffolding support is intended for the attachment to traditional scaffolding pipes. It teaches the traditional diagonal brace and clamping means for securing the device to pipes. Preston, however, does not teach safety means which ensure the grip of clamping means for their device onto a building support member.

Although the clamping means in Preston is a screw type, it requires access to the back of the pipe. Other scaffolding support devices are disclosed in, for example, Jackson, U.S. Pat. No. 3,044,573. Jackson specifically discloses the use of a level mechanism which uses the weight of the scaffold to bear down on a concrete anchor or tie to secure the brace to the concrete wall. Jackson, however, does not teach clamping means for securely gripping a building support member nor does it teach skid resistant means.

In yet another disclosure, Riblet, U.S. Pat. No. 2,854,293, describes a scaffolding support for attachment to a vertical column. Riblet teaches the traditional diagonal brace having a cam mechanism to provide frictional means for preventing the device from sliding down the vertical column to which it is attached. The cam mechanism surrounds the column and provides pressure on the far side via the use of a cam and, like Jackson, gravity helps to turn the cam and apply pressure to the vertical column. Riblet, however, does not teach clamping means for securely gripping a building support member.

The present invention is an improvement over these and other known devices because it allows the device to be used with a stud or other building support member to provide a support for building materials such as scaffolding, roof sheeting, shingles, etc.

SUMMARY OF THE INVENTION

The present invention provides an improved support device for building materials and the like. The device comprises: a body; clamping means attached to an end of the body and having skid-resistant means and a lever mechanism to open and close the clamping means; a brace having slip resistance means and extending diagonally from the other end of the body.

The clamping means is arranged to be secured to a building support member at one end thereof and the brace is arranged to be secured to the building support member at a position spaced from the point of securement of the clamping means, thereby, forming a triangle, i.e., a support device for holding building materials with the body, brace, and building support member.

DETAILED DESCRIPTION OF THE PREFERRED EMBODIMENTS

Figure 1:
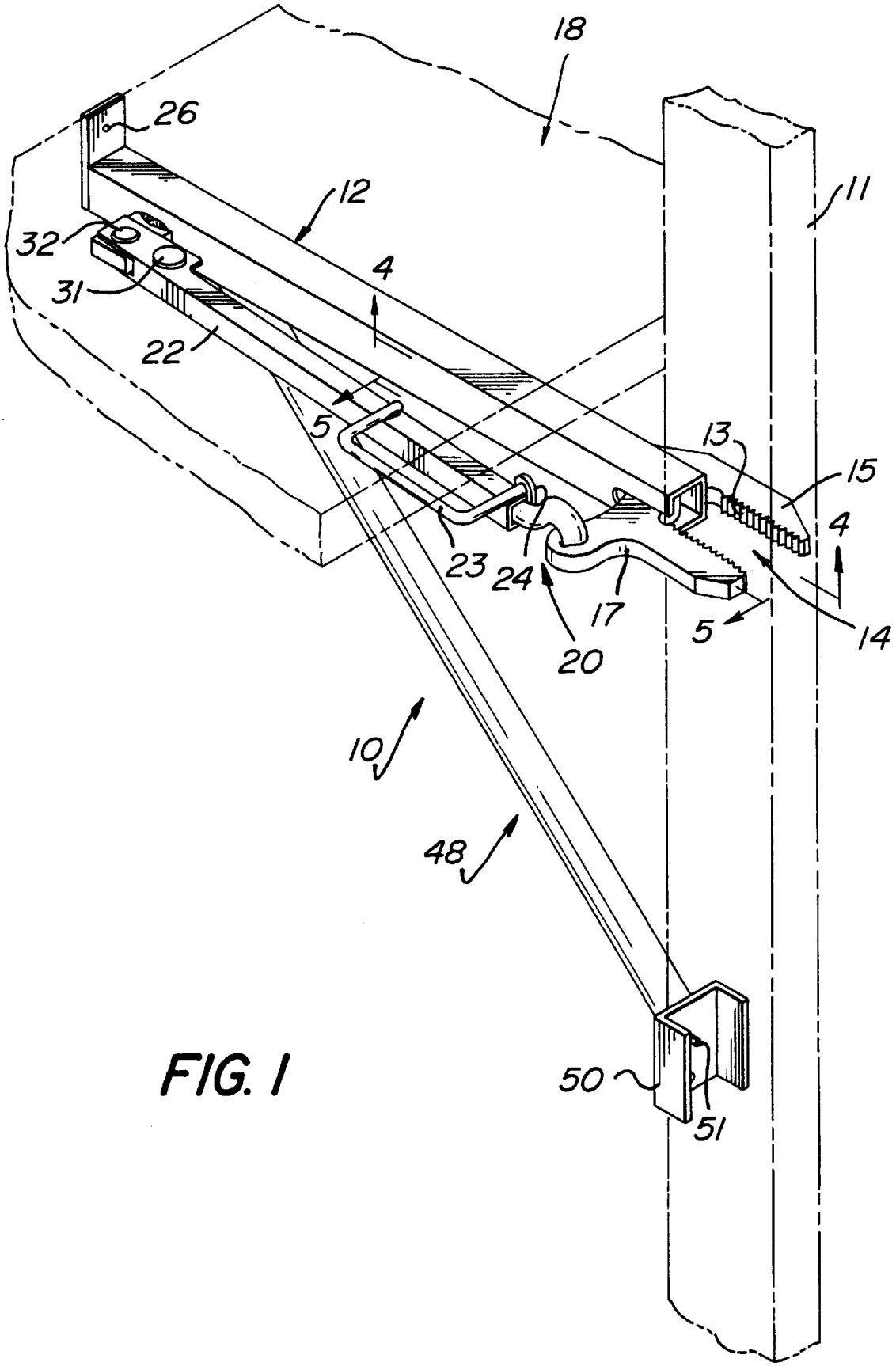
FIG. 1 is a perspective view of the support device of the present invention secured to a building support member.

The building materials support device 10, as shown in FIG. 1, comprises a body 12 to which is attached at one end a clamping means 14 having a stationary jaw 15 and a movable jaw 17, each with skid-resistant means, i.e., teeth 13. The jaws 15, 17 are in a closed position and are securely gripping a building support member, e.g., stud 11, by a lever mechanism 20. At the other end of the body 12 and extending diagonally therefrom is a brace 48 which has slip resistance means to secure the brace 48 onto the building support member, i.e., stud 11, and prevent the brace 48 from slipping.

Referring in greater detail to FIG. 1, essentially all of the components of device 10 are shown. The components include the body 12, clamping means 14 attached to an end of the body 12 and having a stationary jaw 15 and a movable jaw 17, each with skid-resistant means, i.e., teeth 13, on the inner surface of each jaw 15, 17. The movable jaw 17 is arced to accommodate building support members, e.g., stud 11, of various thicknesses.

Figure 2:
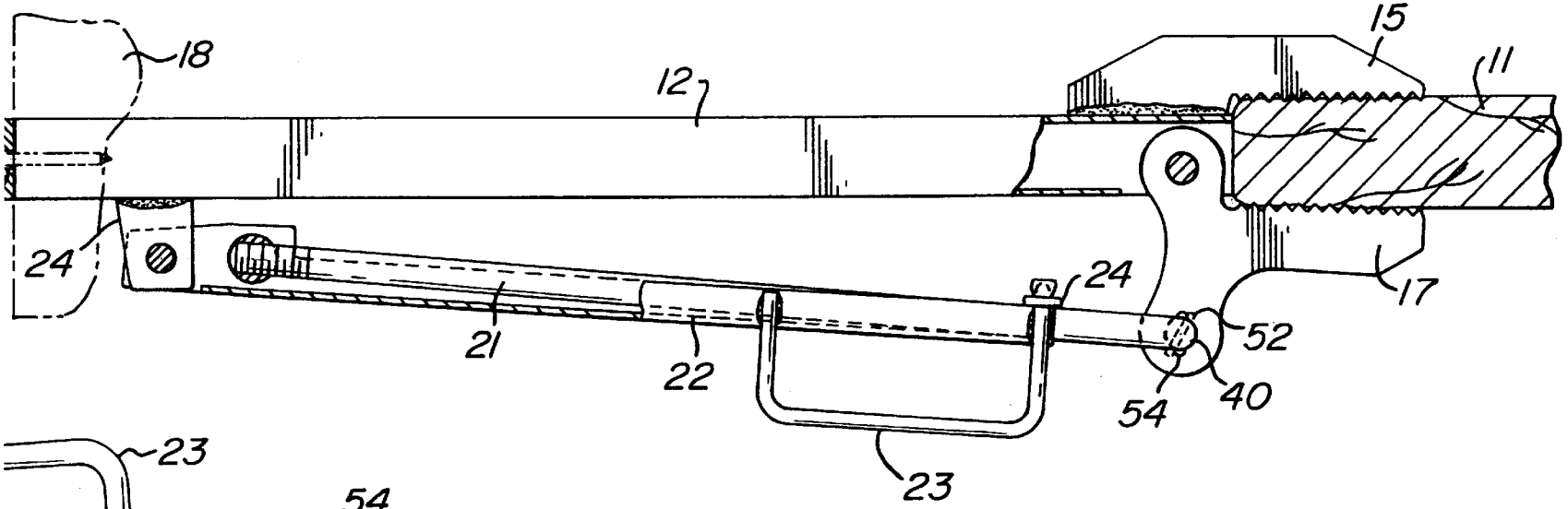
FIG. 2 is a partial sectional view of the support device of FIG. 1 showing the clamping means securely gripping a building support member.

Referring to FIG. 2 and as indicated in FIG. 1, body 12 has a hole 26 in an extreme end opposite to that of which clamping means 14 is attached. In this hole 26, a nail or pin 28 may be placed to enter building material such as scaffolding 18 to securely hold such in place on body 12 of the device.

Figure 4:
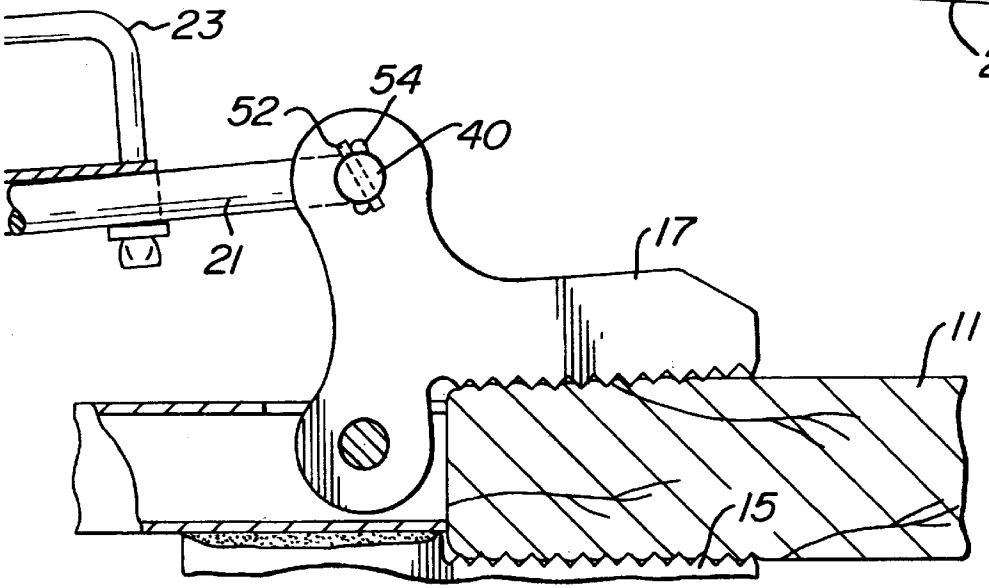
FIG. 4 is a partial sectional view of the clamping means securely gripping a building support member in a position reversed from that shown in FIG. 2.

As shown in FIGS. 2 and 4, the lever mechanism 20 is arranged to open the clamping means 14 and safely close the clamping means 14 to securely grip a building support member such as stud 11. The lever mechanism 20 includes an adjusting bar 21 which is pivoted at one end on an adjustable pivot 31 and positioned and secured at the other end in an opening 40 of the movable jaw 17 of clamping means 14.

As illustrated in FIGS. 1 and 2, a cover arm or "U-shaped" channel 22, is provided for adjusting bar 21 to open and close the movable jaw 17 onto a building support member, i.e., stud 11, to safely secure the device 10 to stud 11 by the skid-resistant means 13 (i.e., teeth) of clamping means 14.

Figure 5:
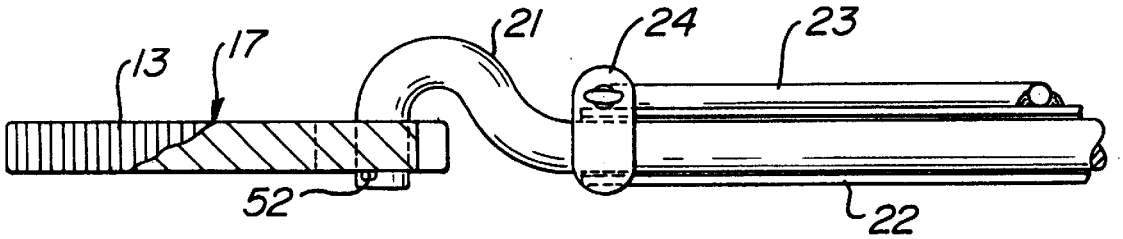
FIG. 5 is a partial sectional view of the lever mechanism of the present device illustrating a locking pendulum latch thereof in a locking position.
Figure 7:
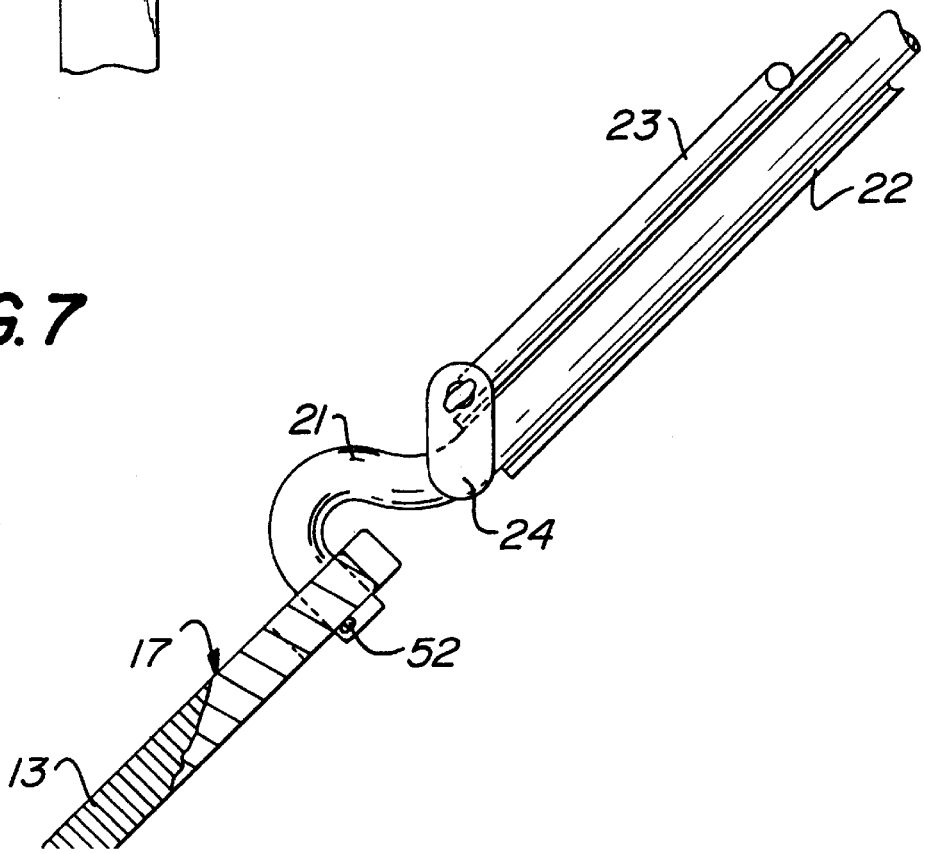
FIG. 7 is a partial sectional view of the lever mechanism similar to that shown in FIG. 5 and illustrating the locking pendulum latch thereof in another locking position.

The cover arm 22, pivoted on fixed pivot 32, is lifted and lowered over the adjusting bar 21 by handle 23. And, as particularly illustrated in FIGS. 5 and 7, a locking pendulum latch 24 is arranged on one end of handle 23 to rotate along the "radius" of adjusting bar 21. This feature is illustrated in FIGS. 5 and 7 and for purposes of safety, i.e., to have the clamping means 14 securely grip the building support member, stud 11, the rotation of "safety" pendulum latch 24 must remain within the "radius" of the adjusting bar 21.

Figure 3:
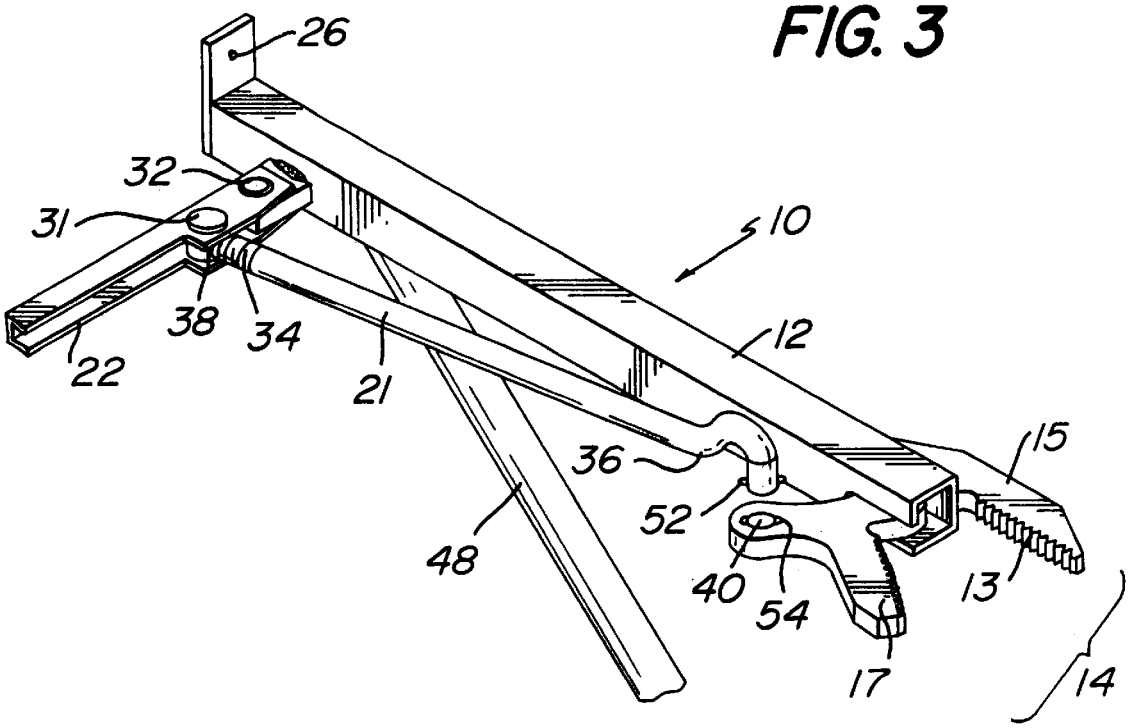
FIG. 3 is a perspective view of the device with the clamping means opened.

The adjusting bar 21 as shown in FIG. 3 is threaded at one end 34 and when the bar 21 is not positioned at the other end 36 in opening 40 of movable jaw 17 of clamping means 14 the bar 21 may be screwed into or unscrewed from a bore 38 of adjustable pivot 31. Accordingly, when adjusting bar 21 is assembled and screwed onto bore 38 the bar 21 is shorter in length, thus, enlarging the opening size of clamping means 14, i.e., space between jaws 15 and 17. With this arrangement, the clamping means 14 can accommodate, i.e., securely grip, building support members of increased thicknesses. Conversely, by unscrewing the adjusting bar 21 from bore 38, the length of bar 21 is increased effecting a reduced opening size of clamping means 14. Thus, the clamping means 14 are arranged to securely grip building support members, i.e., stud 11, of lesser, reduced thicknesses.

Also, for the purpose of safety in using device 10, the adjusting bar 21 has a pin 52 which should not be aligned with slot 54 of opening 40 of movable jaw 17 when the adjusting bar 21 is positioned in opening 40. This lack of alignment or misalignment of pin 52 with slot 54 is essential for safety. This misalignment is illustrated in both FIGS. 2 and 4 where pin 52 is dotted and slot 54 is solid.

Brace 48, as illustrated in FIG. 1, is diagonally extended from an end of the body 12 opposite to that which the clamping means 14 is attached to body 12. As shown, brace 48 appears as a non-movable arm extending from body 12 with an end piece 50, i.e., a small U-shaped channel, arranged to slide over a stud 11 and be secured from slipping from the stud 11 by a slip resistance means 51, a nail-like protrusion, i.e., tit, which enters immediately into stud 11 when the brace end piece 50 is slid onto the stud 11.

As can be seen, a triangle is formed by the body 12, brace 48, and stud 11. This is a very stable triangular support for building materials, such as scaffolds, roofing sheets, and the like.

Figure 6:
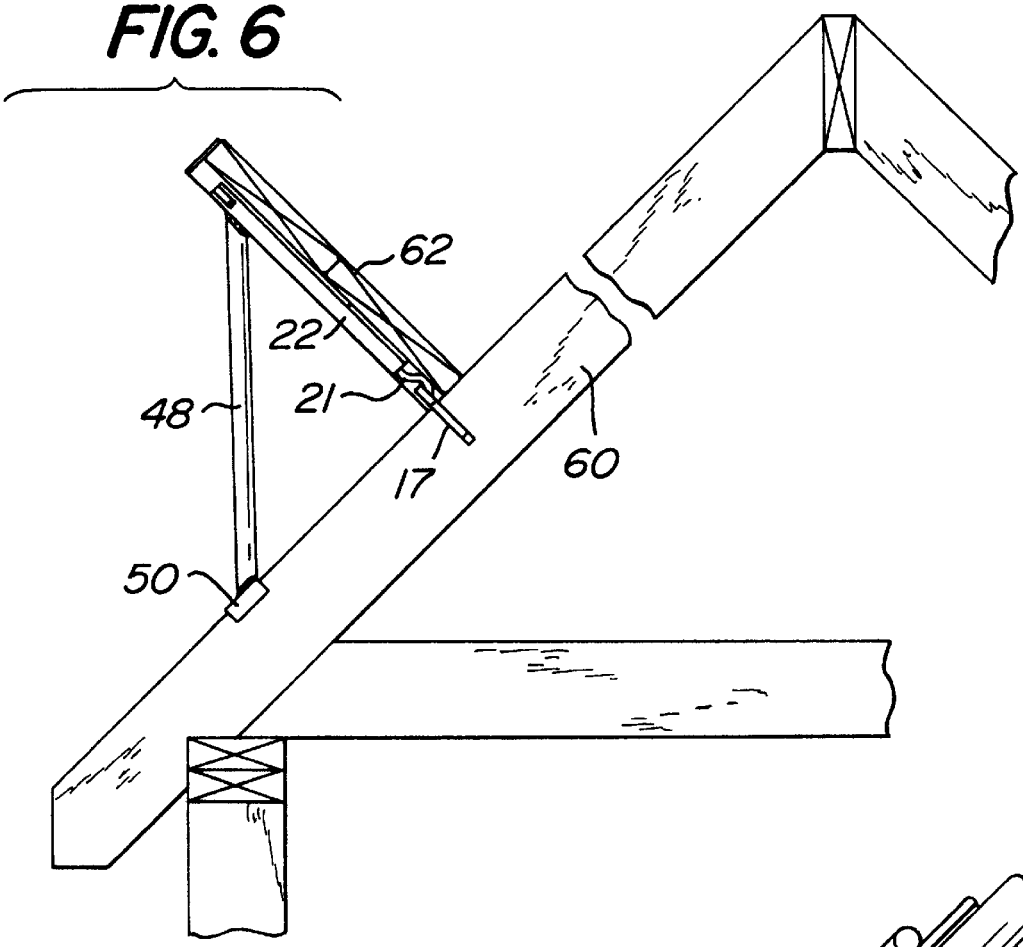
FIG. 6 is a side view showing the present support device secured to a rafter of a roof of a building.

Referring to FIG. 6, the device 10 is shown attached to a rafter 60 of the roof of a building. The device 10 is secured to the rafter 60 by clamping means 14 and brace 48, thus, forming a triangular support with the rafter 60, body 12, and brace 48 for building materials, e.g., roof sheeting or shingles 62. In this arrangement, the support device 10 may be utilized to hold sheeting and the like which may be used in the roofing of a building. Similar to the situation of stud 11 (FIG. 1), a triangular support device is formed by the body 12, brace 48, and rafter 60. Accordingly, the clamping means 14 is secured to the rafter 60 at one end while the brace 48 is secured to rafter 60 at a position spaced from that of clamping means 14.

While the preferred embodiments have been fully described and depicted for the purposes of explaining the principles of the present invention, it will be appreciated by those skilled in the art that modification and changes may be made thereto without departing from the scope of the invention set forth in the appended claims.

What is claimed is:

1. A support device for building materials and the like, for attachment to a building support member, said device comprising:

a body having opposing first and second ends;

clamping means attached to the first end of said body for gripping the building support member, said clamping means having a lever mechanism means for controlling the opening and closing thereof, said clamping means further comprising skid-resistant means for maintaining said clamping means stationary with respect to an associated building support member; and a brace attached to the second end of said body and having slip resistance means for maintaining said brace stationary with respect to said associated building support member, said brace secured to said associated support member at a location spaced apart from said clamping means.

2. The support device of claim 1, wherein the clamping means comprises a movable jaw and wherein the lever mechanism means comprises an adjusting bar means connected to said movable jaw for opening and closing said clamping means such that said clamping means is securely gripping an associated building support member.

3. The support device of claim 2, wherein the adjusting bar means includes means for having its length increased or decreased to reduce or enlarge, respectively, the opening size of the clamping means for allowing said clamping means to securely grip associated building support members of varying thicknesses.

4. The support device of claim 3 wherein the adjusting bar has a cover arm with a handle arranged to lift and lower said adjusting bar to open and close the clamping means.

5. The support device of claim 4, wherein the cover arm has a locking pendulum latch rotatable mounted on the handle, said pendulum latch being arranged to rotate along the radius of said adjusting bar to ensure that the clamping means is in a closed position, thereby capable of securely gripping an associated building support member.

6. The support device of claim 2, wherein the movable jaw of the clamping means is arced to be capable of securely gripping associated building support members of varying thicknesses.

7. The support device of claim 1, wherein said device is constructed of a durable metal selected from the group consisting of steel, plate steel, cast steel, and aluminum.

8. The support device of claim 1, wherein the slip resistance means of said brace is designed to enter instantly into said building support member to prevent any slippage therefrom.

* * * * *